US006931670B2

(12) United States Patent
Arai

(10) Patent No.: US 6,931,670 B2
(45) Date of Patent: Aug. 23, 2005

(54) TURNING OPENING OR CLOSING MEMBER SUPPORTING STRUCTURE OF HELMET

(76) Inventor: Michio Arai, c/o Arai Helmet, Ltd., 12, Azuma-cho 2-chome, Ohmiya-ku, Saitama-shi, Saitama-Ken (JP)

( * ) Notice: Subject to any disclaimer, the term of this patent is extended or adjusted under 35 U.S.C. 154(b) by 0 days.

(21) Appl. No.: 10/628,429

(22) Filed: Jul. 29, 2003

(65) Prior Publication Data

US 2004/0019956 A1 Feb. 5, 2004

(30) Foreign Application Priority Data

Jul. 30, 2002 (JP) ..... 2002-221424
May 9, 2003 (JP) ..... 2003-130955

(51) Int. Cl.[7] ..... A42B 1/08
(52) U.S. Cl. ..... 2/424
(58) Field of Search ..... 2/424, 410, 171.3, 2/425, 6.3, 6.5, 6.7

(56) References Cited

U.S. PATENT DOCUMENTS 3,727,235 A 4/1973 Fisher
4,312,078 A 1/1982 Pollitt et al.
4,766,615 A * 8/1988 Morin et al. ..... 2/421
5,604,930 A * 2/1997 Petit et al. ..... 2/6.5
6,047,409 A * 4/2000 Simpson ..... 2/424

FOREIGN PATENT DOCUMENTS

| | | | | |
|---|---|---|---|---|
| EP | 80202 A2 * | 6/1983 | ..... | A42B/3/00 |
| EP | 558175 A1 * | 9/1993 | ..... | A42B/3/22 |
| FR | 2595921 A1 * | 9/1987 | ..... | A42B/3/22 |
| FR | 2637468 | 4/1990 | | |
| GB | 2201881 A * | 9/1988 | ..... | A42B/3/00 |
| JP | 61174406 | 6/1998 | | |
| JP | 11247018 | 9/1999 | | |
| WO | 8601694 | 3/1986 | | |

* cited by examiner

*Primary Examiner*—Rodney M. Lindsey
(74) *Attorney, Agent, or Firm*—Dykema Gossett PLLC

(57) ABSTRACT

To increase the amount of open air's introduction, have satisfactory good design and operability of a helmet. There are provided a plurality of turning center points of at least two or more during an opening or closing operation of the turning opening or closing member, any one of or more of these turning center points are set outside the operating mechanism and the turning center points are switched over during the turning operation from the closed state to the opened state of the turning opening or closing member.

5 Claims, 12 Drawing Sheets

TURNING OPENING OR CLOSING MEMBER SUPPORTING STRUCTURE OF HELMET

BACKGROUND OF THE INVENTION

1. Field of the Invention

This invention relates to a turning opening or closing member supporting structure in a helmet.

The turning opening or closing member in a helmet is a chin-ventilation in the case of a full-face helmet so as to open or close a ventilation hole and is a shield of a helmet wearing person in both the full-face helmet and a jet-stream type helmet and the like.

The normal turning opening or closing member supporting structure is supported with its single turning center point being applied during its turning operation, and it is opened or closed in such a way that a turning orbit of the opening or closing operation may draw a specified arc.

Due to this fact, as the supporting structure for the shield acting as the aforesaid turning opening or closing member, the applicant had a proposal for a structure in which two separated arc holes are opened, each of the arc holes has two locations of turning center points of the shield so as to cause the turning center points to be switched in sequence during the shield opening or closing operation (refer to Patent Document 1, for example).

2. Related Art

As the related art, there is Gazette of Japanese Patent unexamined publication Hei 11-247018.

At this time, in order to help removing the face shield mist and accumulation of hot air rapidly, efficiency of exchanging air in the helmet should be improved by increasing the volume of introducing outside air. As one of methods therefor, it is thought that the volume of introducing outside air is increased by forming a large ventilating hole.

However, in the case of the chin-ventilation to be fixed to a chin part of the full-face helmet, a size of the chin-ventilation corresponds to a size of the ventilation hole, so that if the chin-ventilation had a supporting form with the aforesaid turning center point being single, for example, as shown in FIGS. 12 and 13, there might be present a possibility that the chin-ventilation 102 sometimes protrudes outside widely from the surface of the chin guard part 101 under the opened state of the chin-ventilation so as to deteriorate a design of the helmet in reference to the supporting position of the chin-ventilation 102.

Accordingly, it may be thought that an angle at the time of opening fully the chin-ventilation is lessened and the volume of protruding is lessened. For such a case, the volume of introducing outside air cannot be increased even if the hole of ventilation is widened.

On the contrary, a method in which the chin-ventilation is opened and closed towards the inside of the helmet can be considered. For this method, the chin-ventilation protrudes widely towards the inside of the helmet, thus a space for the chin-ventilation needs to be kept inside the chin guard portion and such a method cannot be adopted actually from a point of view of operability for opening and closing.

That is to say, it is difficult to set a central point for turning the chin-ventilation enabling the volume of introducing outside air to increase and enabling design and operability to be satisfied.

SUMMARY OF THE INVENTION

In view of the foregoing, the present invention has a subject to realize an increasing in a feeding amount of the open air, improvement in design and operability of the helmet in the turning opening or closing member such as a shield or a chin-ventilation and the like and it is an object of the present invention to provide a new turning opening or closing member supporting structure.

The present invention employs a following technical means for accomplishing the aforesaid object.

The technical means is a turning opening or closing member supporting structure of a helmet, i.e. a member to be opened or closed under its turning action such as a chin-ventilation or a shield, wherein there is provided an operating mechanism for the turning opening or closing member; said operating mechanism has a plurality of arc parts for use in controlling a turning action of the turning opening or closing member at any one of either the helmet or the turning opening or closing member; said arc parts are constituted such that a plurality of more than two arcs having each of different centers of arcs are cooperatively arranged in an integral manner, at least one of the arcs has a center of arc outside the operating mechanism, each of the arc centers including the arc center is coaxial with a center of turning of the turning opening or closing member during its opening or closing operation, and the turning opening or closing member is turned along an orbit of each of the arcs; and thereby the turning opening or closing member is turned along the orbit of each of said arcs while said center of turning is being switched during its opening or closing operation.

DESCRIPTION OF THE PREFERRED EMBODIMENT

Figure 1:
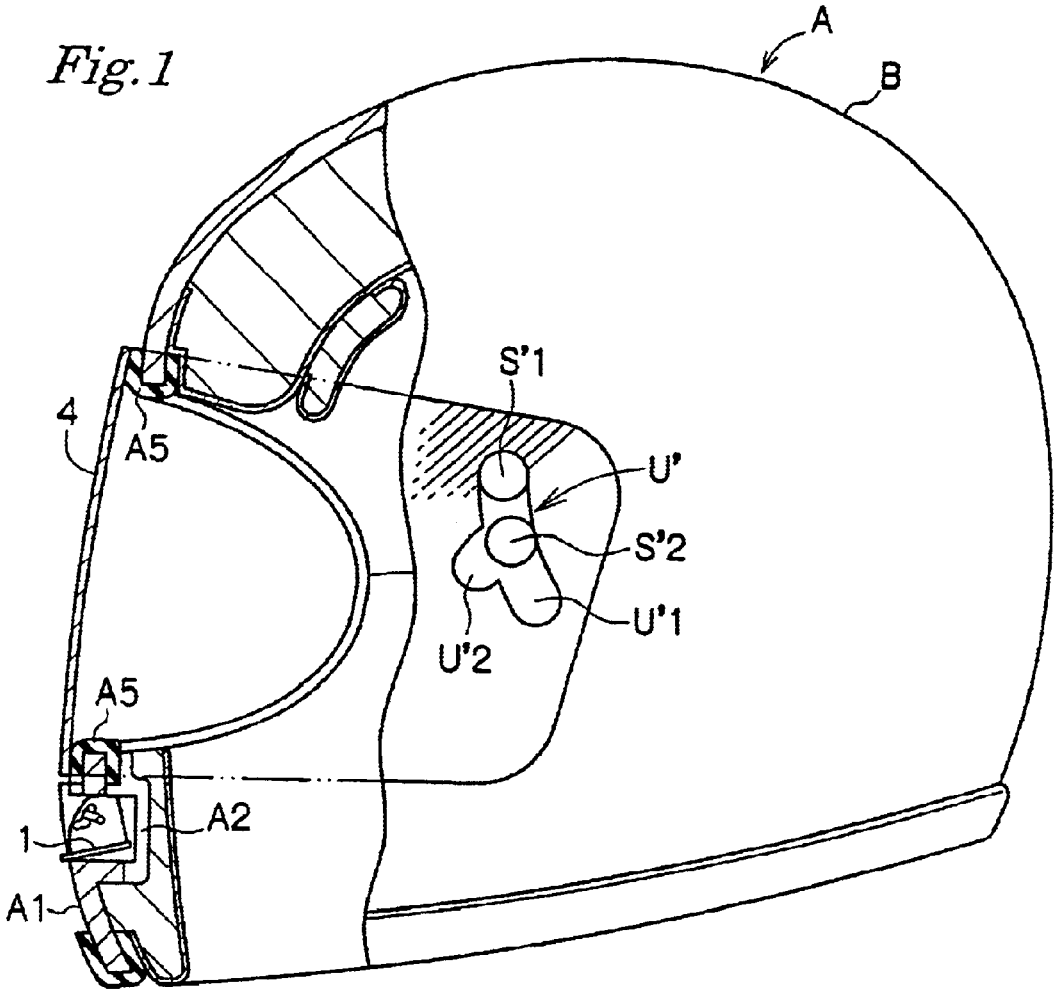
FIG. 1 is a sectional view of a full-face type helmet having a supporting structure of a chin-ventilation and a shield of the present invention.

As shown in FIGS. 1 to 5, as a structure preferable for the chin-ventilation acting as the turning opening or closing member, It is possible to illustrate a structure in which there is provided an arc part (U) at any one of the helmet and the turning opening or closing member, a first guide shaft (S1) and a second guide shaft (S2) slidably engaged to the arc part (U) at the other of the helmet and the turning opening or closing member are provided, turning of the turning opening or closing member is cooperatively controlled by these arc parts (U) and the two guide shafts; as said arc parts (U), a first engaging part (U1) with an arc shape having a center of arc outside the arc parts (U), a second engaging part (U2) with an arc shape having a center of arc inside the arc parts (U) and a third engaging part (U3) with an arc shape having a center of arc common to that of said first engaging part (U1) are integrally and cooperatively arranged; each of the centers of arc is coaxial with the center of turning of the turning opening or closing member and the turning opening or closing member is turned along an orbit of the arc of each of the engaging parts; thereby at the beginning of opening operation of the turning opening or closing member, the turning opening or closing member is guided around the center of turning of the first central point (P1) which is a common arc center held by both engaging parts under a cooperation of the first guide shaft (S1), the first engaging part (U1), the second guide shaft (S2) and the third engaging part (U3); when the first guide shaft (S1) reaches a connecting point between the first engaging part (U1) and the second engaging part (U2) during the opening operation, the center of the second guide shaft (S2) reaches a second central point (P2) of the center of arc held by the second engaging part (U2) and at the same time the center of turning of the turning opening or closing member is switched from said first central point (P1) to the second central point (P2) and it is turned around the second guide shaft (S2)

In addition, as shown in FIGS. 1 and 6–8, as a structure preferable for the supporting structure for a shield acting as the turning opening or closing member, it is possible to illustrate that there is provided an arc part (U') at any one of the helmet and the turning opening or closing member, a first guide shaft (S'1) and a second guide shaft (S'2) slidably engaged to the arc part (U') at the other of the helmet and the turning opening or closing member is cooperatively controlled by these arc parts and the two guide shafts; as said arc parts (U'), a first engaging part (U'1) with an arc shape having a center of arc outside the arc parts (U'), a second engaging part (U'2) with an arc shape having a center of arc inside the arc parts (U') are integrally and cooperatively arranged, each of the centers of arc is coaxial with the center of turning of the turning opening or closing member and the turning opening or closing member is turned along an orbit of the arc of each of the engaging parts; thereby at the beginning of opening operation of the turning opening or closing member, it is turned around the center of turning of the first central point (P'1) which is the center of arc held by the first engaging part (U'1) under a cooperation of the first guide shaft (S'1), the second guide shaft (S'2) and the first engaging part (U'1); when the first guide shaft (S'1) reaches a connecting point between the first engaging part (U'1) and the second engaging part (U'2) during the opening operation, the center of the second guide shaft (S'2) reaches a second central point (P'2) of the center of arc held by the second engaging part (U'2) and at the same time the center of turning of the turning opening or closing member is switched from said first central point (P'1) to the second central point (P'2) and it is turned around the second guide shaft (S'2).

Each of the engaging parts may be formed of either a hole or a groove if each of the guide shafts is engaged with it.

For example, the first engaging part (U1), the second engaging part (U2) and the third engaging part (U3) can be of a grooved shape; the second engaging part (U2) and the third engaging part (U3) of the grooved shape are provided with a step difference, and each of the shafts is not displaced to the other engaging part also at a crossing part of both engaging parts.

In addition, the first engaging part (U'1) and the second engaging part (U'2) can be of a grooved shape; and the first engaging part (U'1) and the second engaging part (U'2) of the grooved shape are provided with a step difference, and each of the shafts is not displaced to the other engaging part also at a crossing part of both engaging parts.

The aforesaid one illustrated above is an embodiment in which there are provided two centers of turning of the turning opening or closing member. However, the present invention is not restricted or limited to this embodiment. For example, the present invention includes also an embodiment in which more than two centers of turning are provided while the center of turning is moved during the turning operation of the engaging parts as found in the engaging part (FIG. 9) including arcs having different curvatures or the engaging part (FIG. 10) having liner lines connected to each other through a curved part of a certain angle.

PREFERRED EMBODIMENTS

The embodiment of the present invention is explained hereinafter with reference to drawings.

Figure 2:
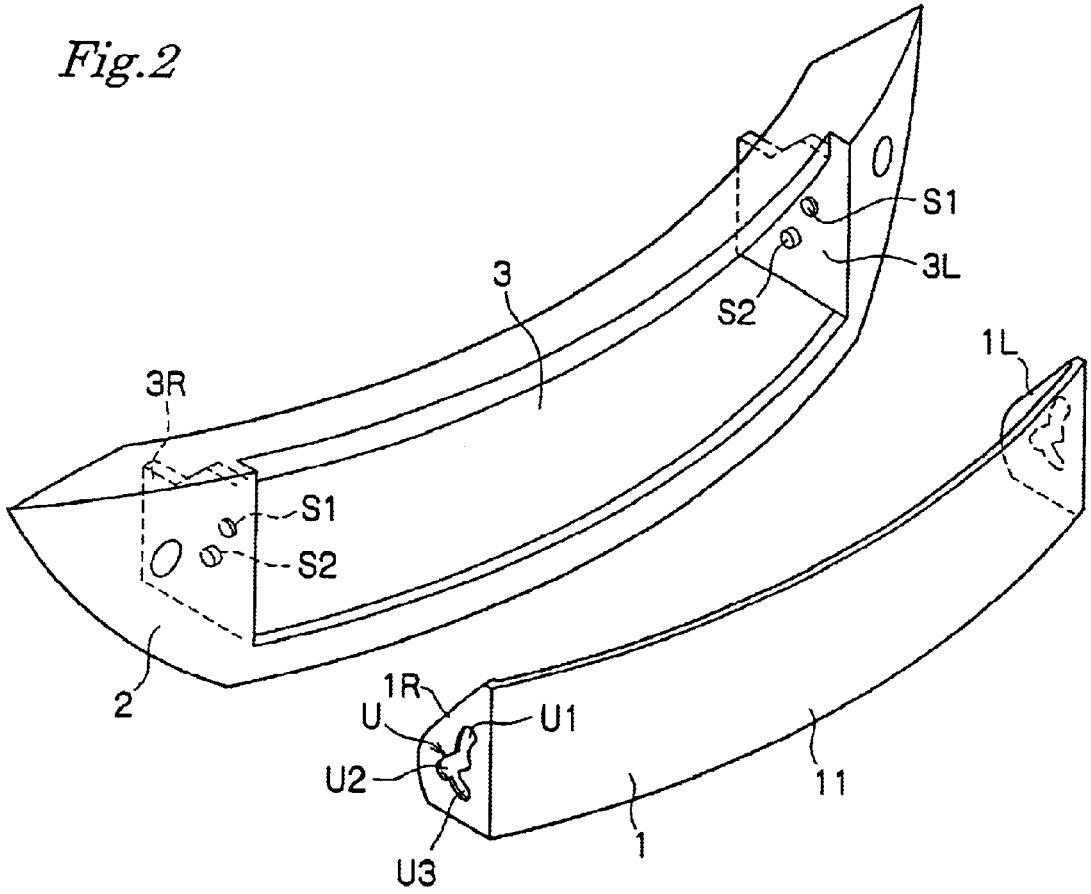
FIG. 2 is a decomposed perspective view of a supporting structure of a chin-ventilation.

FIGS. 1 and 2 illustrate a full-face helmet A, and the full-face helmet A is provided with a ventilation hole A2 opened or closed by a chin-ventilation 1, and with a shield 4 for opening or closing a front opening part A4.

At first, the chin-ventilation 1 acting as the turning opening or closing member will be described.

The chin-ventilation 1 is rotatably supported at a chin-ventilation supporter 2 passed through and fixed to a chin guard part A1 of a helmet B.

The chin-ventilation supporter 2 includes a ventilating hole 3 that is opened and closed by the chin-ventilation 1 and attached to a through hole A3 that is opened by the chin guard part A1, and the surface thereof is formed as a single face to the chin guard part A1.

Figure 3:
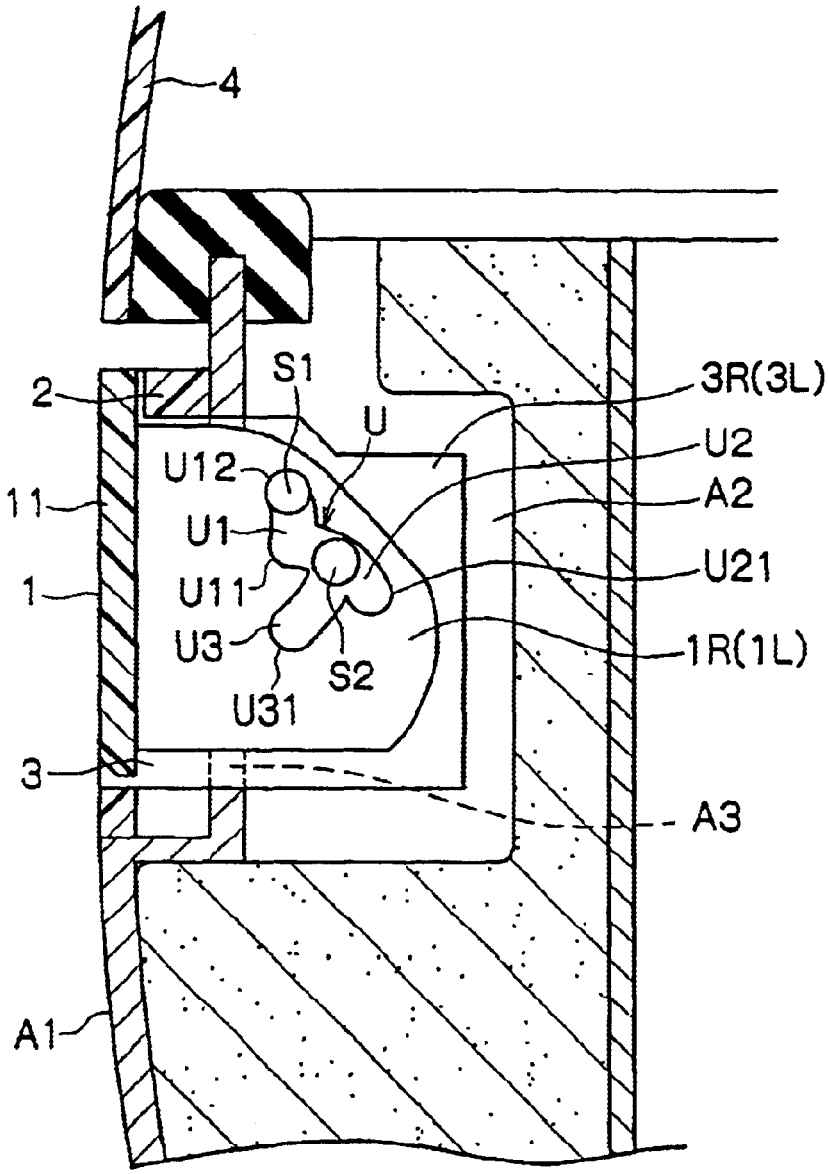
FIG. 3 is a scale up view of a chief portion.
Figure 4:
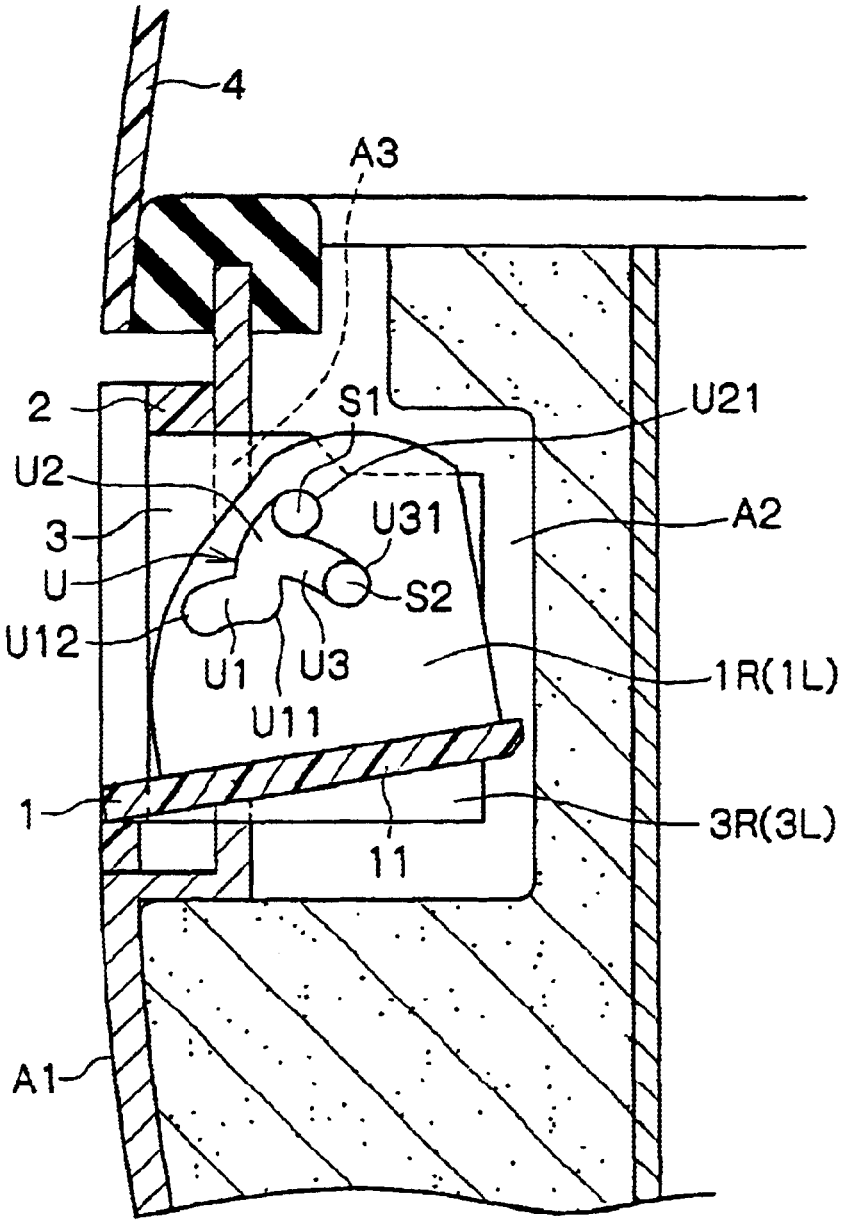
FIG. 4 is a scale up view of a chief portion showing an opening condition.
Figure 5A:
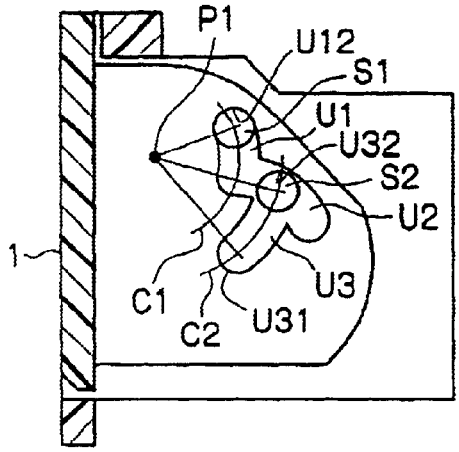
FIGS. 5A, 5B, 5C, 5D, and 5E are some process views of showing opening and closing conditions.
Figure 5B:
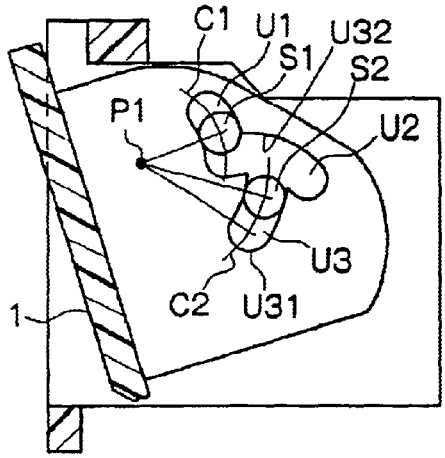
Figure 5C:
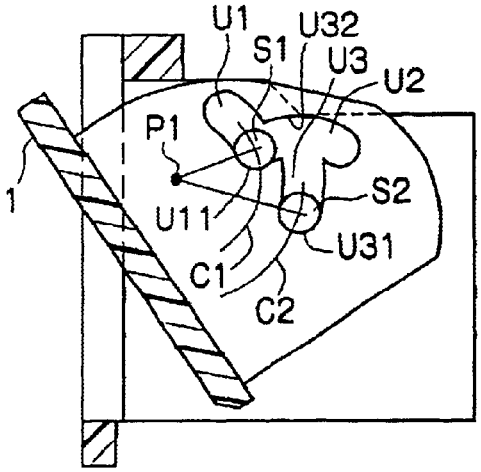
Figure 5D:
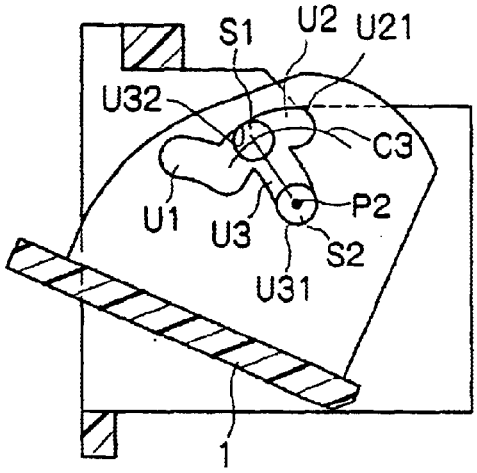
Figure 5E:
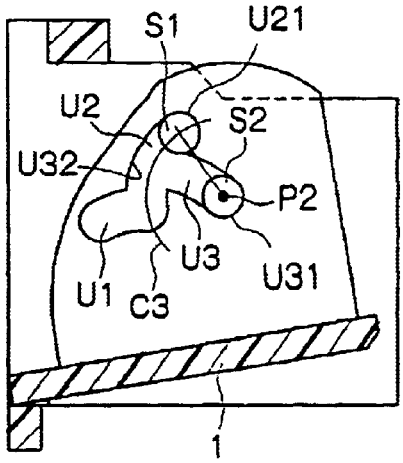

The chin-ventilation 1 is constructed such that it is rotatably supported at the chin-ventilation supporter 2 by an operating mechanism constituted by engaging the first guide shaft S1 and the second guide shaft S2 arranged at each of the right and left sides of the chin-ventilation supporter 2 with the arc parts U formed at each of the right and left sides of the chin-ventilation main body 11 (refer to FIGS. 2 to 4).

The arc parts U in the chin-ventilation 1 are made such that the first arcuate engaging part U1, the second arcuate engaging part U2 and the third arcuate engaging part U3 are integrally and cooperatively arranged; the arcs of the first engaging part U1 and the third engaging part U3 have a common center point outside the operating mechanism (hereinafter called as the first center point P1); an arc of the second engaging part U2 has a center point inside the arc parts U (within the operating mechanism) (hereinafter called as the second center point P2); and an opening or closing operation of the chin-ventilation 1 is carried out while it is being switched over to the first center point P1 and the second center point P2 (refer to FIG. 5).

Further, the first engaging part U1 to the third engaging part U3 are provided with holes at the supporting plates 1L, 1R integrally formed at the right and left sides of the chin-ventilation main body 11.

Additionally, the first guide shaft S1 and the second guide shaft S2 are protruded and formed at the supporting plates 3L, 3R integrally formed to be faced against the supporting plates 1L, 1R at the right and left sides of the ventilation hole 3.

A structure where the center of turning operation of the chin-ventilation 1 during its opening or closing operation is switched over will be described in detail, wherein the first engaging part U1 and the third engaging part U3 at first draw arcs C1, C2 having different diameters around the turning center point P1 during the opening operation from the closed state of the chin-ventilation 1 as shown in FIG. 5, respectively, and it is switched from the first turning center point P1 to the second turning center point P2 coaxial with the second guide shaft S2 during the opening operation of the chin-ventilation 1, and further the second engaging part U2 is formed into a shape to draw the arc C3 with the second turning center point P2 being applied as the turning center point during the opening operation after being switched over.

The first engaging part U1 and the second engaging part U2 are linked in a point in which the first central point P1 is switched to the second central point P2.

A position in which the central point is switched is a position in which a curved portion U11 of the first engaging part U1 touches the first guide shaft S1 on the way to which the chin-ventilation 1 is turned, it is ended to turn about the turning central portion of the first central point P1, and also an end portion U31 of the third engaging part U3 touches the second guide shaft S2. (refer to FIG. 5(*c*))

The opening and closing operation of the chin-ventilation 1 based on thus structured supporting structure is explained with reference to FIGS. 5(*a*) to (*e*).

First of all, as shown in FIG. 5(*a*), in the condition in which the chin-ventilation 1 is closed, the starting portion U12 of the first engaging part U1 touches the first guide shaft S1 and the second guide shaft S2 is positioned in a position (a starting portion U32 of the third engaging part U3) where the second engaging part U2 and the third engaging part U3 cross with each other.

Next, when the chin-ventilation 1 is opened from its full-closed state, as shown in FIG. 5(*b*), the chin-ventilation 1 turns around the turning center point of the first turning center point P1 in such a way that the first engaging part U1 and the third engaging part U3 are guided by the first guide shaft S1 and the second guide shaft S2 to draw the arcs C1, C2.

Then, the chin-ventilation 1 is operated such that the bent part U11 of the first engaging part U1 is contacted with the first guide shaft S1 and the terminal end part U31 of the third engaging part U3 is contacted with the second guide shaft S2 at the position illustrated in FIG. 5(*c*), thereby the turning center point is switched from the first turning center point P1 to the second turning center point P2.

When the chin-ventilation 1 is opened from this position, the chin-ventilation 1 is operated such that the second engaging part U2 is guided by the first guide shaft S1 with the second turning center point P2 being applied as the turning center point to draw the arc C3 as illustrated in FIG. 5(*d*).

Further, for the full open condition, as shown in FIG. 5(*e*), the end portion U21 of the second engaging part U2 touches the first guide shaft S1 and then the chin-ventilation 1 stops turning.

In accordance with the supporting structure for the chin-ventilation 1 of the present preferred embodiment, the front end of the chin-ventilation 1 is not protruded so much from the surface of the chin-ventilation supporting part 2 in an outward direction under its full-opened state, and further an entire region of the ventilation hole 3 can be opened.

Next, the shield 4 acting as the turning opening or closing member will be described.

The shield 4 is rotatably supported at the right and left side surfaces of the helmet B.

The shield 4 is constructed such that it is rotatably supported by the operating mechanism constituted while the first guide shaft S'1 and the second guide shaft S'2 arranged at the helmet B are being engaged to the arc parts U' formed at the right and left ends of the shield.

Although not shown in the drawings in the present preferred embodiment, the base plates are installed at the right and left side surfaces of the helmet, the first guide shaft S'1 and the second guide shaft S'2 are arranged on the base plate, the shield 4 is supported by the shafts and further the supporting structure is hidden by covering it with the shield cover.

Figure 6:
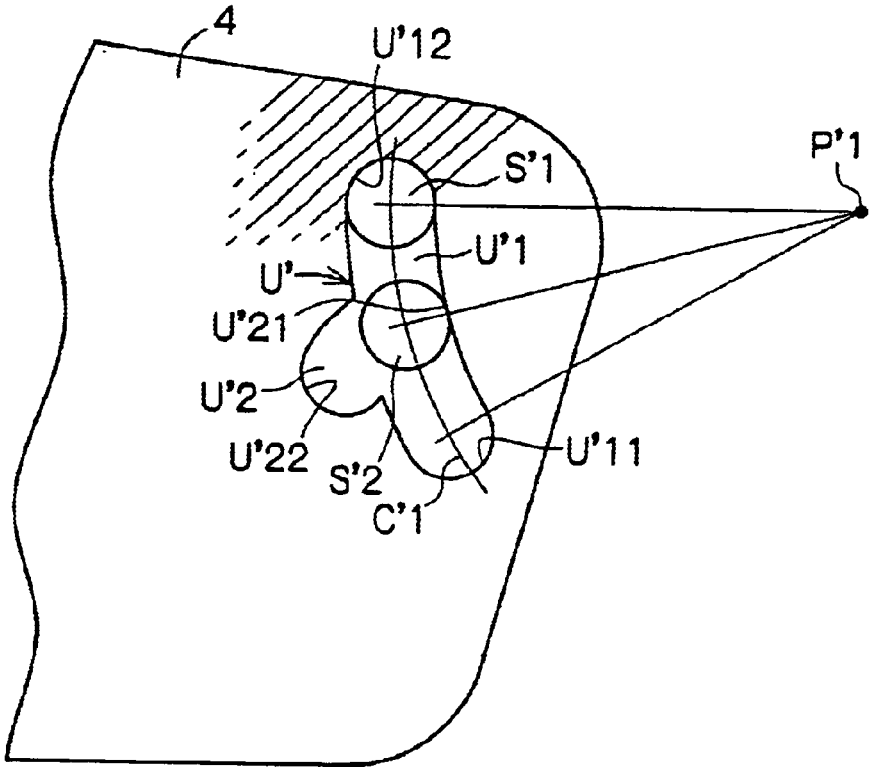
FIG. 6 is a substantial expanded view for showing the supporting structure of the shield.
Figure 7A:
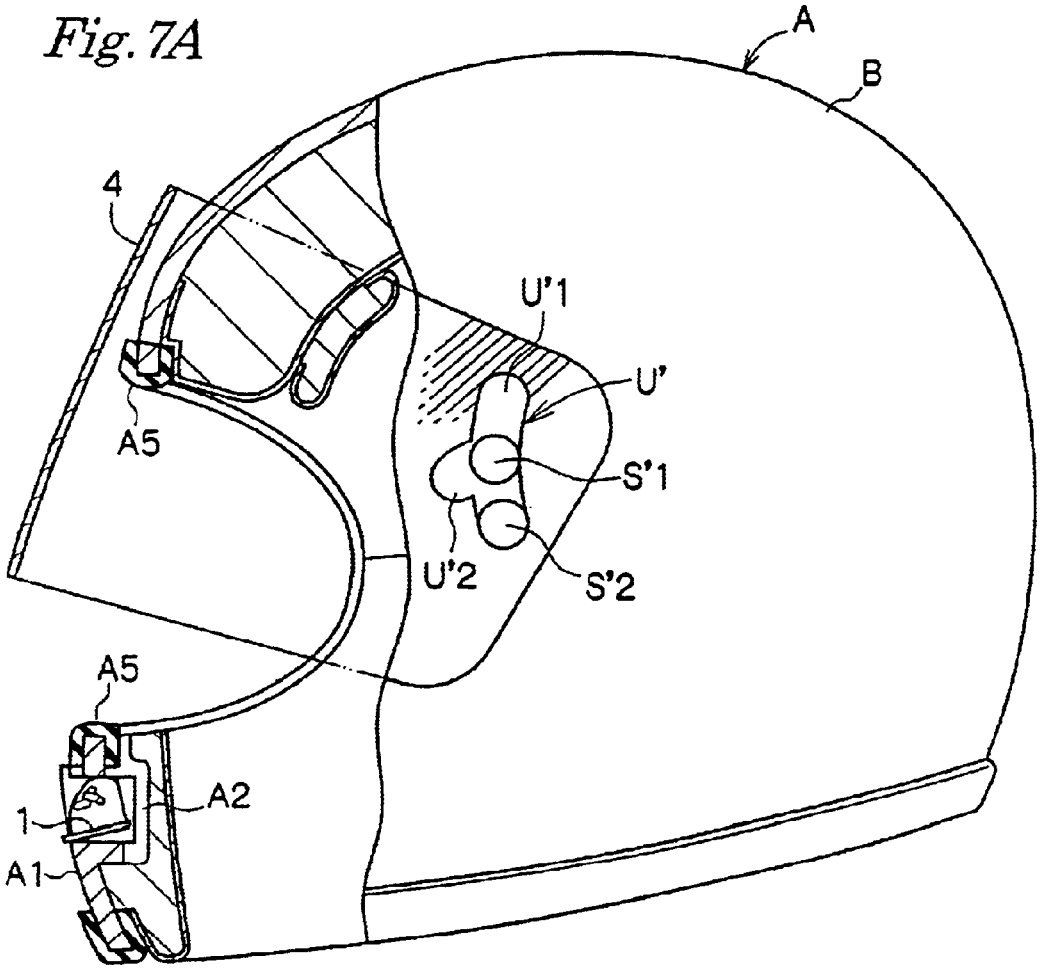
FIGS. 7A and 7B are two process views for showing an opening or closing operation.
Figure 7B:
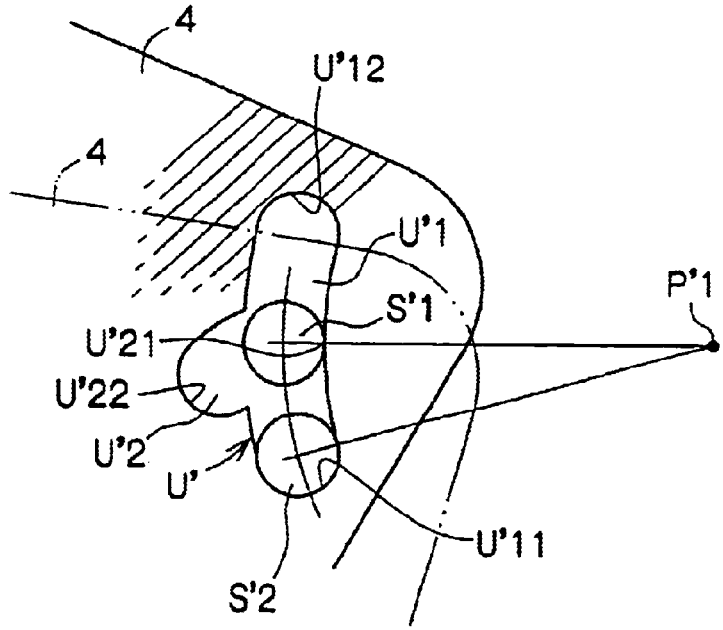
Figure 8A:
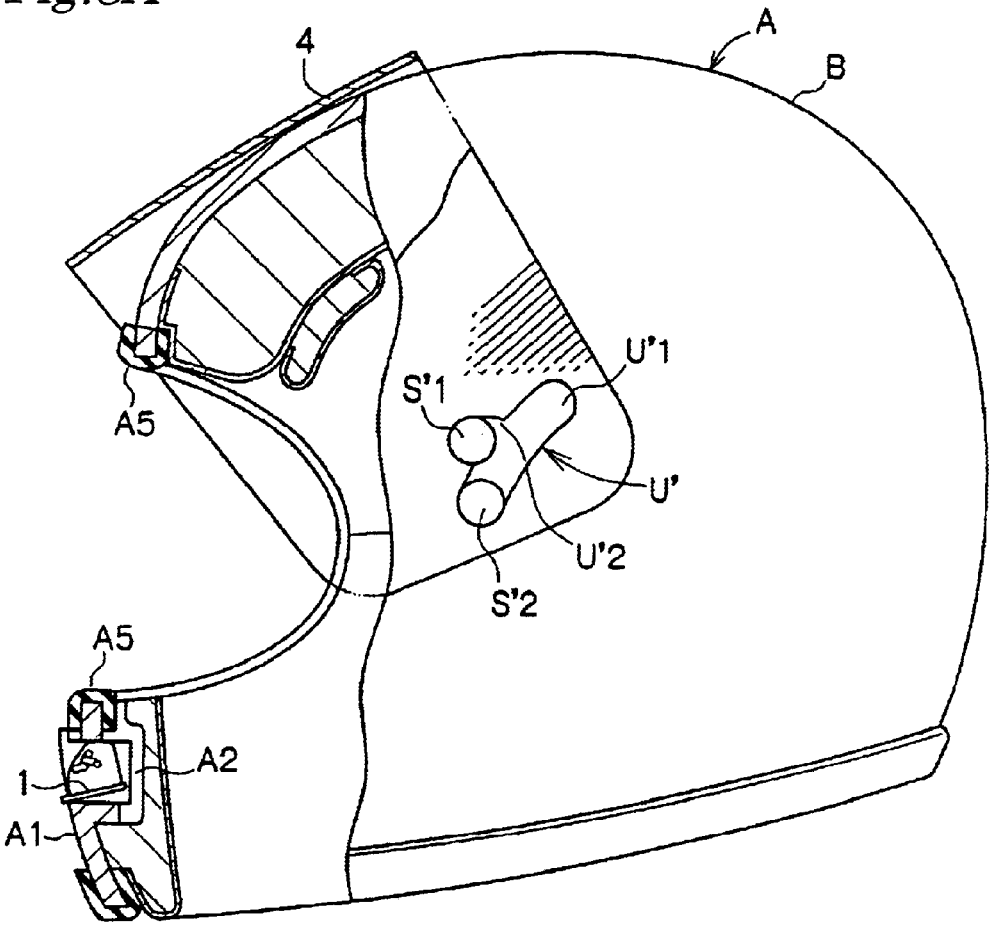
FIGS. 8A and 8B are two process views for showing an opening or closing operation.
Figure 8B:
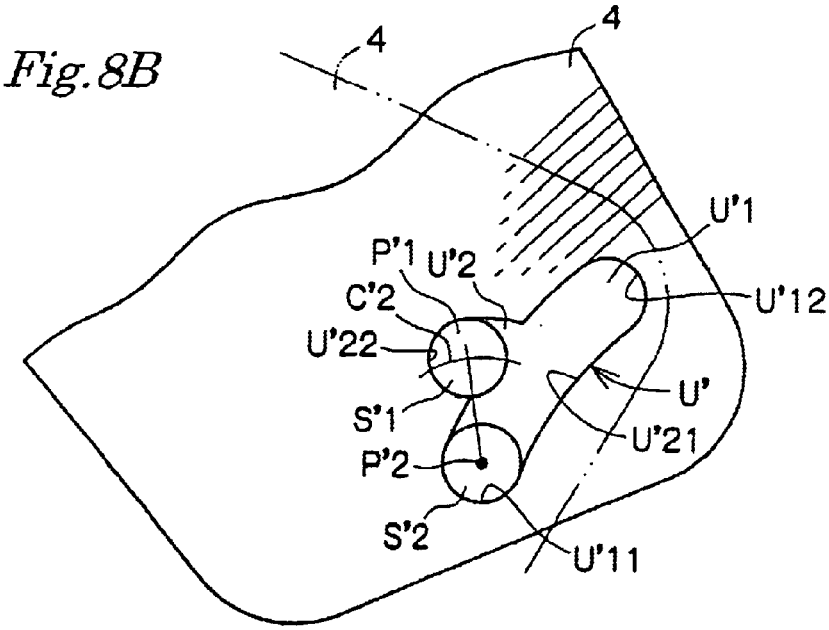

The arc part U' in the shield is made such that the arcuate first engaging part U'1 and arcuate second engaging part U'2 are integrally arranged, the center point of the arc of the first engaging part U'1 is applied as the first center point P'1 set outside the operating mechanism, the center point of the arc of the second engaging part U'2 is applied as the second center point P'2 set inside the arc parts U' (within the operating mechanism), and the opening or closing operation of the shield 4 is carried out while it is being switched over the first center point P'1 and the second center point P'2 (refer to FIGS. 6 to 8).

The structure in which the turning center point at the time of opening or closing of the shield is switched over will be described in detail. As shown in FIGS. 6 to 8, at first the first engaging part U'1 draws an arc C'1 with the first turning center point P'1 being applied as the turning center during the opening operation performed from the closed state of the shield 4, the turning center point is switched over from the first turning center point P'1 to the second turning center point P'2 coaxial with the second guide shaft S'2 during the opening operation, and the second engaging part U'2 is formed to draw the arc C'2 with the second turning center point P'2 being applied as the turning center point.

The first engaging part U'1 and the second engaging part U'2 are cooperatively arranged at a position where it is switched from the first turning center point P'1 to the second turning center point P'2.

The position where the center points are switched over corresponds to a position where an end part at the second guide shaft S'2 in the first engaging part U'1 (hereinafter called as "the terminal end part U'11" and an opposite end part is called as "the starting end part U'12") is contacted with the second guide shaft S'2 during the turning operation of the shield 4 and the turning is stopped with the first turning center point P'1 being applied as the turning center point and at this time, the end part U'21 (a cooperative part with the first engaging part U'1) of the second engaging part U'2 is accurately opposing against the second guide shaft S'2 (refer to FIG. 7(*b*)).

Referring to FIG. 1 and FIGS. 6 to 8, an opening or closing operation of the shield 4 under an operation of the supporting structure as described above will be described.

At first, as shown in FIGS. 1 and 6, under the full-closed state of the shield 4, the starting end part U'12 of the first engaging part U'1 is contacted with the first guide shaft S'1.

At this time, the shield 4 is closely contacted with a rimmed rubber A5 of the opening part A4 of the helmet B.

Next, as shown in FIGS. 7(*a*), (*b*), when the shield 4 is opened from its full-closed state, the shield is operated such that the first engaging part U'1 is guided by the guide shaft S'1 with the first turning center point P'1 being applied as the turning center point to draw the arc C'1 and as shown in FIG. 7(*b*), the terminal end U'11 of the first engaging part U'1 is contacted with the second guide shaft S'1 , thereby the turning center point is switched from the first turning center point P'1 to the second turning center point P'2.

At this time, as shown in FIG. 7(*a*), the shield 4 is turned to move away from the rimmed rubber A5.

As shown in FIGS. 8(*a*), (*b*), when the shield 4 is opened from this position, the shield 4 is operated such that the second engaging part U'2 is guided by the first guide shaft S'1 with the second turning center point P'2 being applied as a turning center point to draw the arc C'2, and as shown in FIG. 8(*b*), the terminal end U'2 of the second engaging part U2' is contacted with the first guide shaft S'1 to cause the turning of the shield 4 to be stopped and to cause it to attain a full-opened state.

At this time, as shown in FIG. 8(*a*), the shield 4 occupies the state where it is approached to the surface of the helmet B.

In accordance with the supporting structure for the shield 4 in the preferred embodiment of the present invention, the shield 4 is closely contacted with the rimmed rubber A5 under its full-closed state and the shield 4 can be approached to the surface of the helmet B under its full-opened state.

Figure 9:
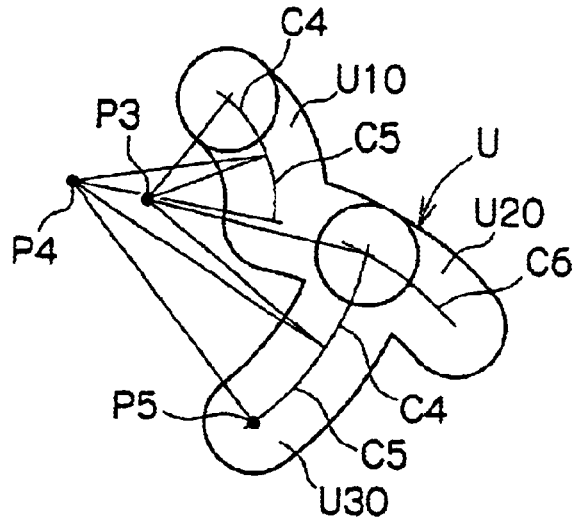
FIG. 9 shows another embodiment of each engaging part.
Figure 10:
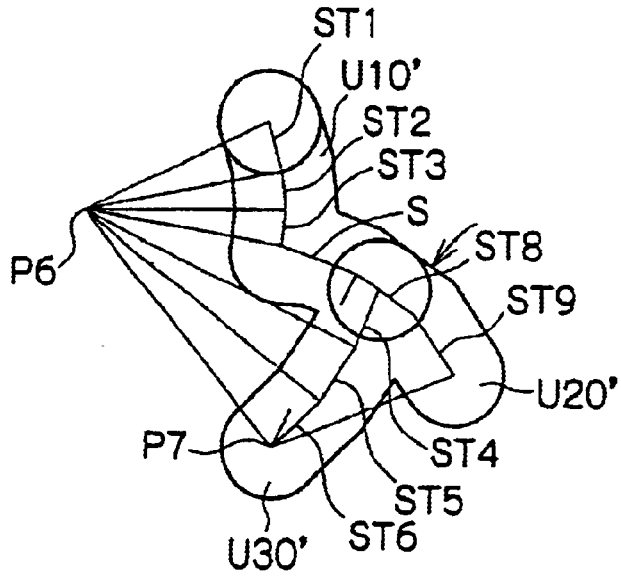
FIG. 10 shows the other embodiment of each engaging part.

FIGS. 9 and 10 explain each case that two or more turning center points are provided in the chin-ventilation 1.

At this stage, engaging parts of FIG. 9 are defined as the first engaging part U10, the second engaging part U20, and the third engaging part U30 respectively. Engaging parts of FIG. 10 are defined as the first engaging part U10', the second engaging part U20', and the third engaging part U30' respectively.

For the forms of the first engaging part U10 and the third engaging part U30 of FIG. 9, each curvature of the arc of the engaging part changes at a halfway point and each turning center point for turning along the arc having different curvature exist.

To give an actual example, the radius of arcs C5, C5' at the aforementioned halfway turning center point to the end portion is lengthened than arcs C4, C4' at the starting portion to the halfway turning center point. Thus, the position of the first central point P3 as the turning center point of arcs C4, C4' is different from the second central point P4 as the turning center point of arcs C5, C5'.

That is to say, the turning center point of the arcs C4, C4' is the first central point P3. When a turning operation is switched to the turning operation along the arcs C5, C5' smoothly from this halfway turning operation, the turning center point moves to the second central point P4 from the first central point P3 gradually, thus it is switched to the second central point P4.

In this case, there exist plural center points between the first central point P3 and the second central point P4 because it is performed to turn along the engaging parts U10, U30 when the turning center point moves to the second central point P4 from the first central point P3.

Then, while it is ended to turn along the arc C5 having the turning center point of the second central point P4, it is started to turn along an arc C6 having the turning center point of the third center point P5.

Therefore, the turning center points of the chin-ventilation of the aforementioned embodiment have three points, such as the first, second, and third center point, and plural center points existing between the first central point P3 and the second central point P4. It is also possible to embody a structure in which there exist three or more turning center points.

The embodiments of the first engaging part U10', the second engaging part U20', and the third engaging part U30' of FIG. 10 have a form structured by connecting plural straight lines ST1 to ST9 by way of each shape's curved portion.

This structure is made such that the turning operation is regulated at the time that each guide shaft touches the curved portion in turning operation of the chin-ventilation. Using this regulation, a ratchet function comes to be effective to the operation of opening the chin-ventilation.

Further, for this structure, strictly speaking the chin-ventilation cannot move as a turning movement since the chin-ventilation moves along each straight line, but the chin-ventilation performs the movement nearly the same as the turning movement in view of the whole movement of the chin-ventilation.

That is to say, since it is performed to try to turn by moving along each straight line, a gap is caused during the movement thereof. In general, it can be judged that it is performed to turn about the turning center point of a turning center point P6 and center point P7.

Therefore, the embodiment of the present invention has two or more turning center points.

Figure 11:
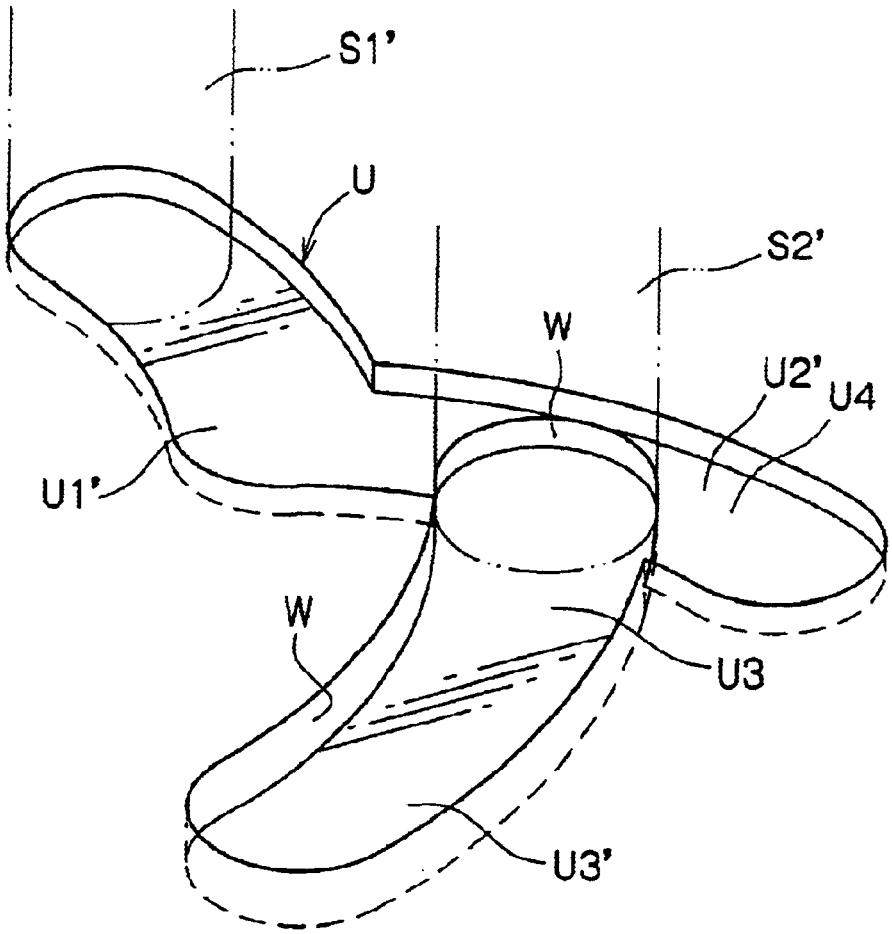
FIG. 11 is a perspective view of another embodiment of the first engaging part and the second engaging part.
Figure 12:
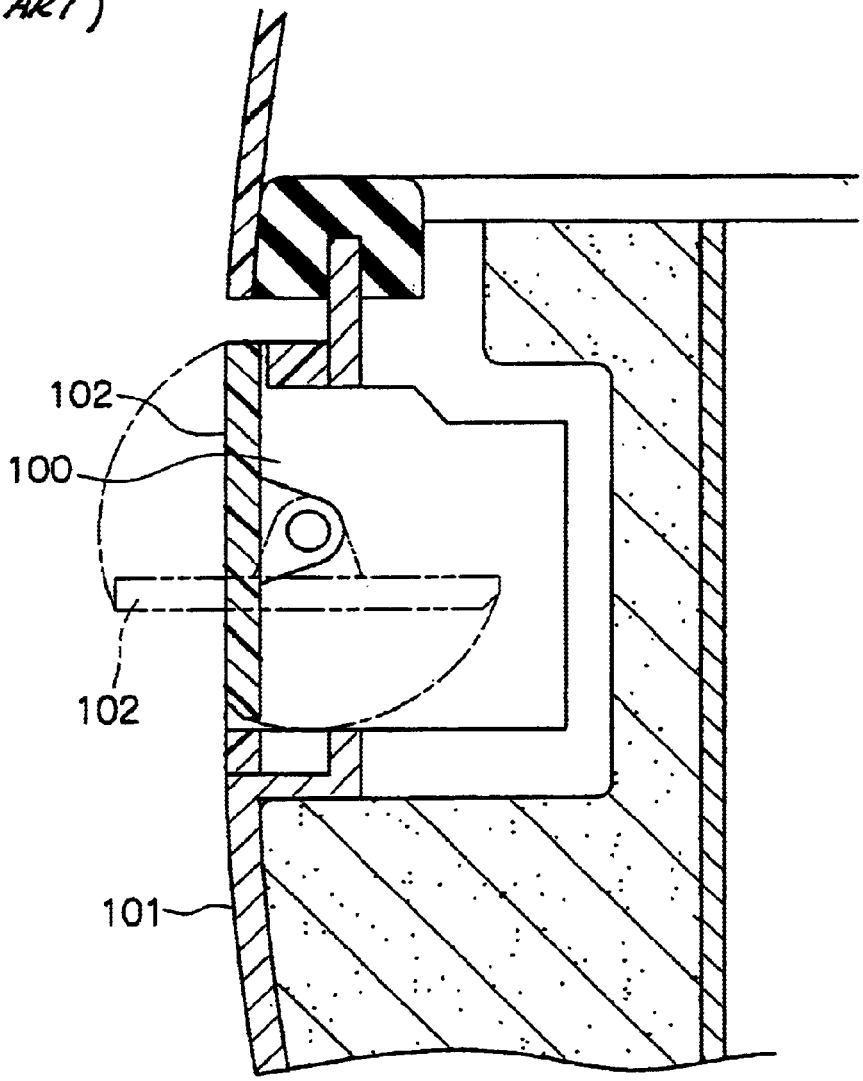
Fig. 12 (PRIOR ART)
FIG. 12 is a sectional view of a conventional supporting structure.
Figure 13:
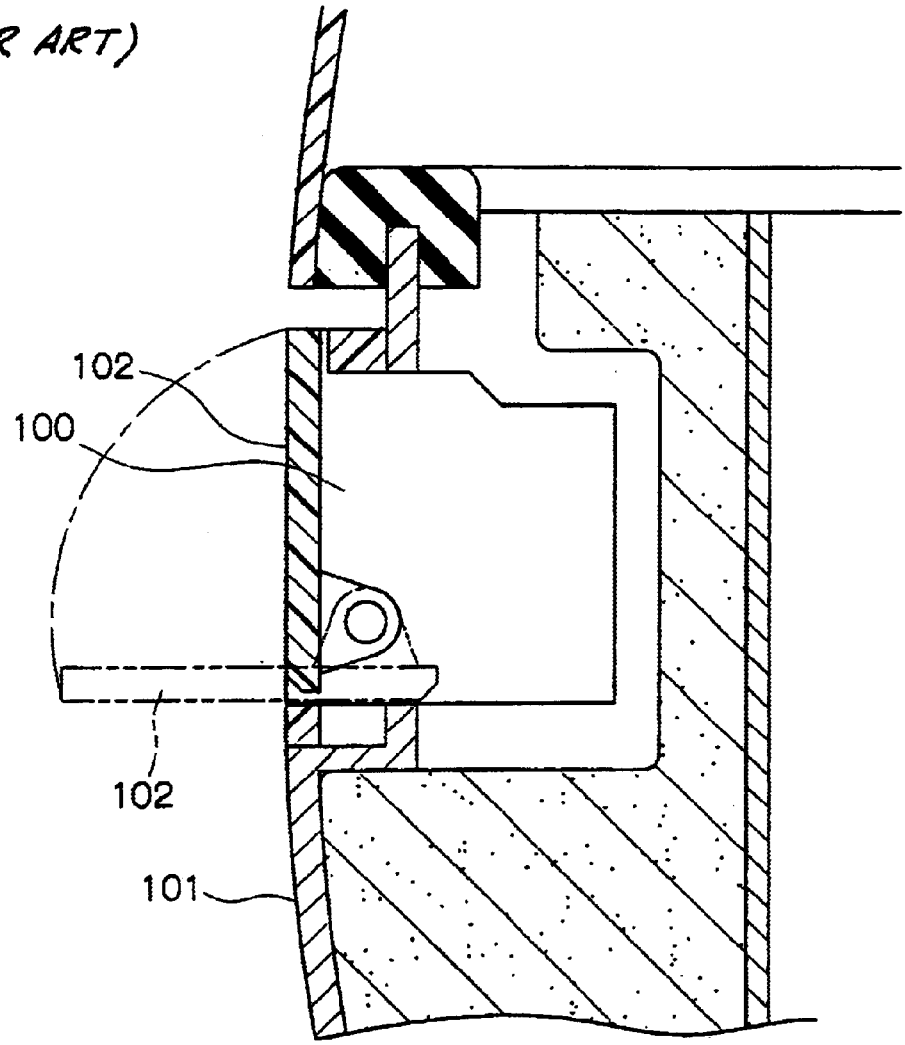
Fig. 13 (PRIOR ART)
FIG. 13 is a sectional view of a conventional supporting structure.

Although the first engaging part U1 and the second engaging part U2 of the aforementioned embodiment are explained as through holes, it is possible for the present invention to have a channel structure arbitrarily as shown in FIG. 11.

In the following, although the embodiment of the first engaging part and the second engaging part having the channel structure of the present invention are explained hereinafter, reference characters U1', U2' and U3' are used to the first engaging part, the second engaging part, and the third engaging part of the present invention respectively.

Further, the reference characters S1' and S2' are used to the first guide shaft and the second guide shaft respectively.

For the basic outer shape, the first engaging part U1' the second engaging part U2', and the third engaging part U3' are totally the same as the first engaging part U1, the second engaging part U2, and the third engaging part U3 respectively.

The height position of the bottom face U3 of the third engaging part U3' is positioned in one step lower position than the bottom face U4 of the first engaging part U1' and the second engaging part U2'. Accordingly, a wall face type step difference W is formed around the third engaging part U3'.

The first guide shaft S1, has an approaching length to a bottom portion U4 of the first engaging part U1'. The second guide shaft S2' has an approaching length to the bottom portion U3 of the third engaging part U3'. The second guide shaft S2' is held by the aforementioned step difference W and it is kept to be securely engaged to the inside of the third engaging part U3'.

According to the present embodiment, in the same way as the aforementioned embodiment, for the full open condition, the whole area of the ventilating hole 3 can be opened without letting the top end portion of the chin-ventilation 1 protrude in the outer direction from the surface of the chin-ventilation supporter 2. Besides, the second guide shaft S2' can be maintained in the third engaging part U3' more securely by the step difference W.

Further, the preferred embodiment shown in FIGS. 9 to 11 can be applied to the supporting structure for the shield shown in FIGS. 6 to 8.

As has already been described, the supporting structure for the turning opening or closing member of the present invention can also be used as the supporting structure for the chin-ventilation and the supporting structure for the shield.

That is, the supporting structure can be easily formed even in such a small member as the chin-ventilation and further the turning of the shield in compliance with the shape of the helmet can be carried out.

In particular, in the case of the supporting structure where any one of the turning center points is present outside the operating mechanism, the supporting structures for the chin-ventilation and the shield are effective.

In the case that the turning opening or closing member is a chin-ventilation, the front end of the chin-ventilation is not protruded so much outwardly from the surface of the chin-ventilation supporting part and further a substantial entire region of the ventilation hole can be opened.

Accordingly, it is possible to increase a feeding amount of the open air, its operability.

In the case that the turning opening or closing member is a shield, the shield can-be held under its full-opened state to a state where it is approached to the surface of the helmet.

For example, even if a protruded member is present at the surface of the helmet, the turning center point of the shield is switched from the midway part of the opening operation while the shield avoiding the protruded member at the beginning of the opening operation and it is approached to the surface of the helmet under its full-closed state.

Further, in the case that the supporting structure of the present invention is employed in the off-road helmet having a flange, the full-open angle of the shield can be set in compliance with an angle of the flange, so that when the shield is raised, it can be easily stored and held inside the flange.

In other words, molding of the helmet in compliance with the shape coinciding with a human's head is originally required in view of a function of the helmet and the shape of the helmet in compliance with the turning of the shield is not suitable. However, the supporting structure of the present invention can realize the turning operation of the shield in compliance with the shape of the helmet.

Accordingly, it is possible to satisfy a superior design characteristic of the helmet and its operability.

Further, the engaged state of the guide shafts into the engaged parts is held more positively due to the step difference in addition to the aforesaid effect, so that the present invention has a quite superior effect in view of performing the positive turning and guiding of the turning opening or closing member without causing the guide shafts to be displaced from the engaging part at the time of opening or closing operation of the turning opening or closing member.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A turning opening or closing member supporting structure of a helmet, wherein there is provided an operating mechanism for the turning opening or closing member over a helmet and the turning opening or closing member;

said operating mechanism has a plurality of arc parts for use in controlling a turning action of the turning opening or closing member at any one of either the helmet or the turning opening or closing member;

said arc parts are constituted such that a plurality of more than two arcs having each of different centers of arcs are cooperatively arranged in an integral manner, at least one of the arcs has a center of arc outside the operating mechanism, each of the arc centers including the arc center is coaxial with a center of turning of the turning opening or closing member during its opening or closing operation, and the turning opening or closing member is turned along an orbit of each of the arcs; and thereby the turning opening or closing member is turned along the orbit of each of said arcs while said center of turning is being switched during its opening or closing operation.

2. A turning opening or closing member supporting structure, wherein the turning opening or closing member is a chin-ventilation;

an operating mechanism for the turning opening or closing member provided over a helmet and the turning opening or closing member is provided with an arc part (U) at any one of the helmet and the turning opening or closing member, with a first guide shaft (S1) and a second guide shaft (S2) slidably engaged to the arc part (U) at the other of the helmet and the turning opening or closing member, a turning of the turning opening or closing member is cooperatively controlled by the arc part (U) and the two guide shafts;

as said arc part (U), a first engaging part (U1) with an arc shape having a center of arc outside the operating mechanism, a second engaging part (U2) with an arc shape having a center of arc inside the operating mechanism and a third engaging part (U3) with an arc shape having a center of arc common to that of said first engaging part (U1) are integrally and cooperatively arranged;

each of the centers of arc is coaxial with the center of turning of the turning opening or closing member and the turning opening or closing member is turned along an orbit of the arc of each of the engaging parts; thereby at the beginning of opening operation of the turning opening or closing member, the turning opening or closing member is guided around the center of turning of a first central point (P1) which is a common arc center held by the the first and third engaging parts under a cooperation of the first guide shaft (S1), the first engaging part (U1), the second guide shaft (S2) and the third engaging part (U3);

when the first guide shaft (S1) reaches a connecting point between the first engaging part (U1) and the second engaging part (U2) during the opening operation, the center of the second guide shaft (S2) reaches a second central point (P2) of the center of arc held by the second engaging part (U2) and at the same time the center of turning of the turning opening or closing member is switched from said first central point (P1) to the second central point (P2) and it is turned around the second guide shaft (S2).

3. A turning opening or closing member supporting structure, wherein the turning opening or closing member is a shield;

an operating mechanism for the turning opening or closing member provided over a helmet and the turning opening or closing member is provided with an arc part (U') at any one of the helmet and the turning opening or closing member, with a first guide shaft (S'1) and a second guide shaft (S'2) slidably engaged to the arc part (U') at the other of the helmet and the turning opening or closing member, a turning of the turning opening or closing member is cooperatively controlled by the arc part and the two guide shafts;

as said arc part (U'), a first engaging part (U'1) with an arc shape having a center of arc outside the operating mechanism, a second engaging part (U'2) with an arc shape having a center of arc inside the operating mechanism are integrally and cooperatively arranged, each of the centers of arc is coaxial with the center of turning of the turning opening or closing member and the turning opening or closing member is turned along an orbit of the arc of each of the engaging parts; thereby at the beginning of opening operation of the turning opening or closing member, it is turned around the center of turning of the first central point (P'1) which is the center of arc held by the first engaging part (U'1) under a cooperation of the first guide shaft (S'1), the second guide shaft (S'2) and the first engaging part (U'1);

when the first guide shaft (S'1) reaches a connecting point between the first engaging part (U'1) and the second engaging part (U'2) during the opening operation, the center of the second guide shaft (S'2) reaches a second central point (P'2) of the center of arc held by the second engaging part (U'2) and at the same time the center of turning of the turning opening or closing member is switched from said first central point (P'1) to the second central point (P'2) and it is turned around the second guide shaft (S'2).

4. A turning opening or closing member supporting structure according to claim 2, wherein the first engaging part (U1), the second engaging part (U2) and the third engaging part (U3) are of a grooved shape;

the second engaging part (U2) and the third engaging part (U3) of the grooved shape are provided with a step difference, and each of the shafts is not displaced from one engaging part to another engaging part also at a crossing part of both engaging parts.

5. A turning opening or closing member supporting structure according to claim 3, wherein the first engaging part (U'1) and the second engaging part (U'2) are of a grooved shape; and the second engaging part (U'1) and the second engaging part (U'2) of the grooved shape are provided with a step difference, and each of the shafts is not displaced from one engaging part to another engaging part also at a crossing part of both engaging parts.

* * * * *